US006000991A

United States Patent [19]

Truchsess et al.

[11] Patent Number: 6,000,991

[45] Date of Patent: Dec. 14, 1999

[54] HELICAL COIL SPRING TOY AND A RESPONSE DEVICE THEREFOR

[75] Inventors: Joseph Truchsess, Ridgefield, Conn.; Patrick Stobbs, Bronx, N.Y.

[73] Assignee: Pragmatic Designs, Inc., Portchester, N.Y.

[21] Appl. No.: 09/048,639

[22] Filed: Mar. 26, 1998

[51] Int. Cl.[6] ..... A63H 5/00

[52] U.S. Cl. ..... 446/397; 446/486

[58] Field of Search ..... 446/176, 213, 446/397, 486, 491, 404, 408, 484, 188, 81; 84/723, 734, 735, 737, 600, DIG. 24; 482/74, 84, 900

[56] References Cited

U.S. PATENT DOCUMENTS

| | | | |
|---|---|---|---|
| D. 234,789 | 4/1975 | Rosenberg . | |
| 2,479,790 | 8/1949 | Strumor . | |
| 2,854,786 | 10/1958 | Sabo . | |
| 3,047,980 | 8/1962 | Bischoff . | |
| 3,587,006 | 6/1971 | Weingartner et al. . | |
| 3,719,908 | 3/1973 | Fidi . | |
| 4,114,306 | 9/1978 | Molenaar . | |
| 4,187,635 | 2/1980 | Deissler . | |
| 4,744,279 | 5/1988 | Livingston | 84/1.01 |
| 4,904,222 | 2/1990 | Gastgeb et al. | 446/405 |
| 4,920,848 | 5/1990 | Suzuki . | |
| 4,977,811 | 12/1990 | Suzuki et al. | 84/600 |
| 5,431,591 | 7/1995 | Muzzi | 446/397 |
| 5,533,949 | 7/1996 | Hwang | 482/47 |
| 5,692,737 | 12/1997 | Perlsweig | 267/168 |
| 5,782,668 | 7/1998 | Chabert | 446/220 |

*Primary Examiner*—Robert A. Hafer
*Assistant Examiner*—Jeffrey D. Carlson
*Attorney, Agent, or Firm*—Cohen, Pontani, Lieberman & Pavane

[57] ABSTRACT

An amusement device for a helical coil spring toy that generates a response such as sound or light whenever the wave of the helical coil spring changes direction. The amusement device includes two end caps affixed to the two free ends of the coil spring. One of the two end caps is an active end cap which houses the mechanism for generating the response. When the helical coil spring is compressed at the active end cap end a trigger switch activates an integrated circuit thereby producing the desired response. When the wave of compressed coils travels to the passive end cap a second response is produced by a time delay circuit so that user selective alternating responses are produced each time the wave of coils travels from one end cap to the other.

19 Claims, 5 Drawing Sheets

FIG. 1
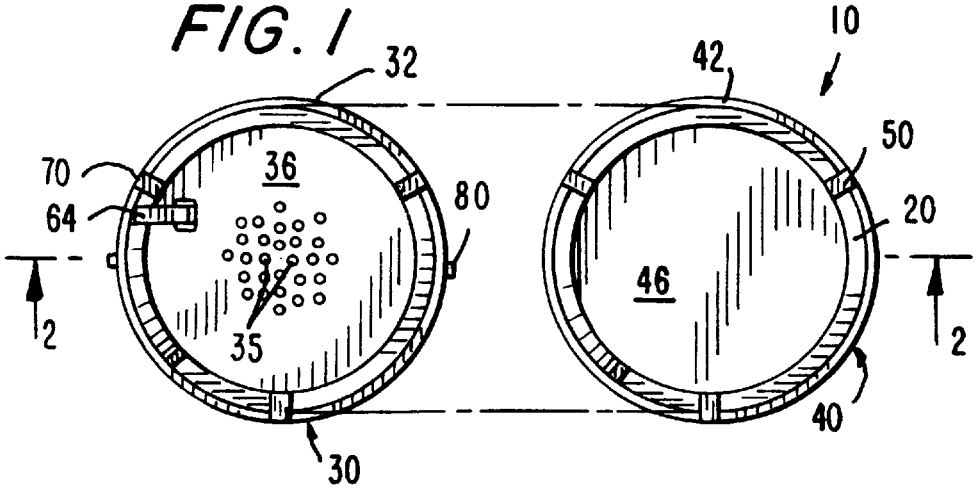
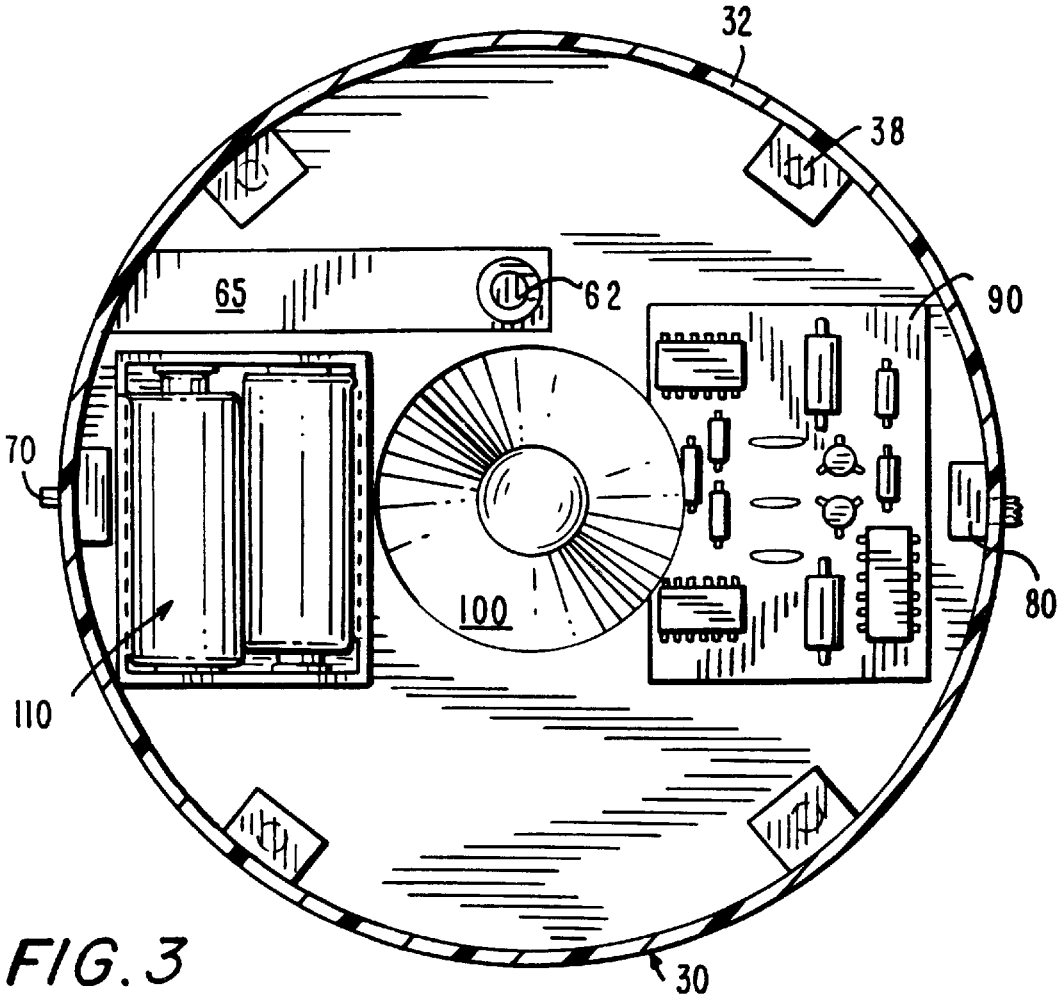
FIG. 3

HELICAL COIL SPRING TOY AND A RESPONSE DEVICE THEREFOR

BACKGROUND OF THE INVENTION

1. Field of the Invention

The present invention relates to a helical spring toy and a response device therefor and in particular a device which combines the action of a helical coil spring toy with a response each time the wave of expanded coils changes direction.

2. Description of the Related Art

A helical coil spring toy that produces an action is well known in the art, such type of toys being popular for many years under the trademark SLINKY. The helical coil spring toy comprises a metal or plastic type helical coil, which can be easily compressed or stretched by a small child. The helical coil spring toy can be placed at the top of a stairway so that when correctly propelled the helical coil spring toy travels end over end thereby appearing to "walk" down the stairs. The toy can also be utilized in other ways, for example by holding one end in each hand and then exciting the toy to produce a wavelike motion of the spring.

Several prior art inventions combine the action of a spring type toy with some form of a sound response. U.S. Pat. No. 5,431,591, for example, discloses a hand-held helical coil spring toy having a tone generator at one end. Varying musical tones are generated as the spring is manually compressed and released based upon the amount of pressure with which the tone generator is grasped. Although this device generates a musical tone when the tone generator is stimulated, no sound is produced when the end not having the tone generator is excited.

Another hand-held helical coil spring toy is disclosed in U.S. Pat. No. 4,187,635, and has a resonator and diaphragm that amplify the natural frequency of the spring. This device must be manually activated, and as a further disadvantage, does not produce electronically generated sounds. As a further example of the prior art, U.S. Pat. No. 4,904,222 discloses a response device having a signal generator attached to a flexible spring-like member. When the flexible member is waved, a sound is produced, which varies in relation to the amount of flexure. A first tone is produced with respect to an electronic oscillatory signal and a second tone is generated when the frequency of the oscillatory signal exceeds a predetermined value. This response device does not have a helical coil spring element.

SUMMARY OF THE INVENTION

It is an object of the present invention to provide a helical coil spring toy and a response device therefor which produces a response when the wave of the coils changes direction, and particularly wherein a response is generated each time an end of the spring contacts a surface, such as the case where the spring toy "walks" end over end down a flight of stairs.

The present invention is a response device for use with a helical coil spring toy, that generates a response, such as sound or light, whenever the wave of the coils changes direction. The inventive device comprises two end caps which are affixed to the two free ends of the coil spring. One of the two end caps is an active end cap, having a housing which contains the mechanism for generating the response. The other end cap is a passive end cap, having a housing similar to the active end cap, but without the response mechanism. A unique feature of the present invention is that not only is a response generated when the wave of coils changes direction at the active end cap, but a response is also generated when the wave of coils changes direction at the passive end cap.

Each end cap forms a housing having a sidewall, a top member attached to the edge of the sidewall facing the coil spring, and a bottom member removably attached to the other edge of the sidewall. Clips disposed along the perimeter of each top member secure a free end of the coil spring to each end cap. In another embodiment of the present invention, the end caps are cylindrical in shape, matching the configuration of the coil spring. It is to be understood however, that the end caps may be of any number of different shapes, for example, hexagonal and any number of interesting designs and colors. Furthermore, the end caps are formed of a plastic type material, although other materials, such as metals or resins, may be used.

The active end cap houses a trigger switch assembly comprising a normally closed trigger switch which activates the response mechanism via a pivotally mounted lever having an end being contactable at the trigger switch and having another end which passes through the top member so as to be contactable at the free end of the coil spring. The response mechanism includes the trigger switch, a selector switch, an ON-OFF switch, the speaker and a battery, all of which are connected by wires to a circuit board having an integrated circuit chip. A compression spring is disposed between the top member and the lever at a point proximal the end of the lever contactable at the trigger switch. The compression spring urges the lever to contact the trigger switch so as to deactivate the response mechanism.

When the helical coil spring is uncompressed at the active end cap, the compression spring holds the lever in contact with the trigger switch, and no response is generated. However, when the end of the coil spring affixed to the active end cap is compressed, the coil spring depresses the lever so that the lever is pivoted away from the trigger switch, thereby activating the response mechanism.

In one embodiment of the present invention, immediately upon triggering the response mechanism, a first sound effect is produced at the speaker placed within the active end cap. Simultaneously, a time delay circuit is activated, which is programmed to produce a second sound effect at the speaker at the moment the wave of coils of the toy changes direction, i.e., is compressed, at the passive end cap. Alternatively, the integrated circuit chip is programed to generate a first output signal each time the trigger switch is activated so as to produce a first response, and a second output signal at a predetermined amount of time after the first output signal is generated so as to produce a second response. In this fashion a distinct response appears to be triggered at each end cap as the wave of coils travels from one end cap to the other. An additional feature is that the selector switch allows a user to select from different pairs of sound effects, which are stored on the integrated chip.

In another embodiment of the present invention, an "averaging" circuit senses that the spring toy is being operated. The "averaging" circuit may require several actuations of the trigger switch to effect activation of the response mechanism and may require several seconds of inactivity before the response is discontinued. In this manner a continuous uninterrupted sound, such as music, is produced for as long as the toy is operated.

To operate the present invention according to the above embodiments, the helical spring coil toy is typically positioned at the top of a stairway. The toy is then propelled so that the spring travels end over end from one step to the next, thereby appearing to "walk" down the stairs. In accordance with the above embodiments, either alternating sound effects are produced as each end contacts a step, or a continuous sound is produced until the toy stops or reaches the bottom of the stairs.

In another embodiment of the present invention, the active end cap has a sound module. The sound module is electrically connected both to the active end cap and to the free end of the coil spring at the active end cap. A remote switch is electrically connected both to the passive end cap and to the free end of the coil spring at the passive end cap. An electrically conductive material is placed on the outer surface of each end cap. A user's hands are placed on the conductive surface of the end caps and the coil spring is manually compressed and released. When the coil spring is compressed the remote switch closes thereby completing an electrical circuit from the user's hand at the active end cap, through the active end cap, remote switch, coil spring, passive end cap, the user's hand at the passive end cap and continuing through the user's body back to the hand at the active end cap. Completion of the circuit activates the sound module thereby generating a response. A lip circumferentially arranged around the outer surface of the end caps prevents the user's hands from contacting the spring and bypassing the remote switch. Furthermore, a local switch permits activation of the sound module.

Once operation and/or spring wave reversal times are able to be sensed, a variety of responses can be produced. Motorized devices, sounds, and lights are among the responses that can be incorporated.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

FIG. 1 is a top view of the present invention, showing an active end cap on the left side of the figure and a passive end cap on the right side of the figure;

FIG. 3 is a sectional top view taken along lines 3—3 of FIG. 2;

DETAILED DESCRIPTION OF THE PRESENTLY PREFERRED EMBODIMENTS

Figure 2:
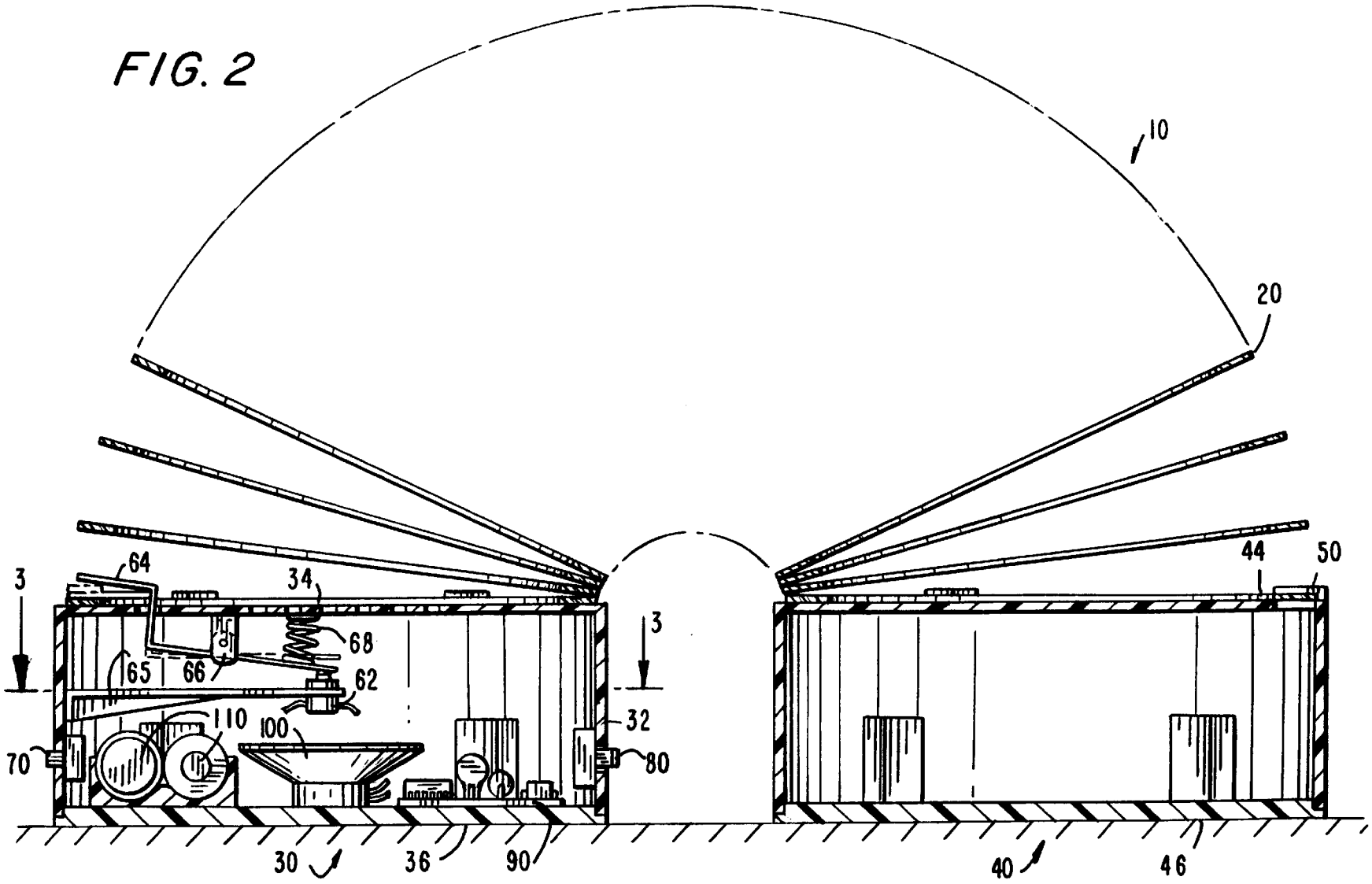
FIG. 2 is a sectional side view taken along lines 2—2 of FIG. 1.

FIGS. 1 through 3 illustrate a first embodiment of the response device 10 of the present invention. The response device 10 comprises a helical coil spring 20, an active end cap 30 and a passive end cap 40. The active end cap 30 has a sidewall 32, arranged between a top member 34 and a bottom member 36 so as to form a generally cylindrical enclosure, the top member 34 being affixed to an edge of the sidewall 32. The bottom member 36 is removably attached to several mounting blocks 38 disposed on the interior surface of the sidewall 32. The passive end cap 40 has a sidewall 42, arranged between a top member 44 and a bottom member 46 so as to form a generally cylindrical enclosure. The top member 44 is affixed to an edge of the sidewall 42 and the bottom member 46 is affixed to another edge of the sidewall 42. A plurality of clips 50 are provided near the perimeter of the top members 34, 44 for securing the free ends of the helical coil spring 20 to the respective end caps 30, 40.

A printed circuit board 90, which will be described in greater detail below, is mounted to the bottom 36 so as to be inside the active end cap 30. A speaker 100 and a battery holder 110 are also mounted to the bottom member 36, both being wired to the printed circuit board 90. Also wired to the printed circuit board 90 are three switches, a trigger switch 62, a select switch 70 and an ON/OFF switch 80. The trigger switch 62 activates the response device, the select switch 70 allows the user to choose one response from a number of possible responses, and the ON/OFF switch 80 disconnects power to the circuit, all of which are described in greater detail herein below. The select switch 70 and the ON/OFF switch 80 are mounted to the inside of the sidewall 32, and protrude through openings in the sidewall so as to be accessible from outside the active end cap 30. The trigger switch 62 is mounted through an opening in a bracket 65, that is affixed to the interior of the sidewall 32 so as to extend inward towards the middle of the enclosure. Extending downward from the top 34 is a pivot 66 to which a roughly Z-shaped lever 64 is rotatably attached. One end of the lever 64 protrudes through the top member 34, enabling the lever 64 to be contacted by a coil of the helical coil spring 20 when the helical coil spring 20 is in a compressed state at the active end cap 30. A compression spring 68 is disposed between the top member 34 and the other end of the lever 64 thereby urging the lever 64 downward so that the lever 64 contacts the trigger switch 62 when the spring 20 is not compressed at the active end cap 30.

The trigger switch 62 is a normally closed push button type switch so that when the helical coil spring 20 is compressed at the active end cap 30 the helical coil spring 20 pushes down on the end of the lever arm 64 protruding through the top wall 34 so that the other end of the lever arm 64 rotates upward against the spring 68 thereby opening the contact of the trigger switch 62 which, as will be described later, activates a response. When the end of the helical coil-spring 20 affixed to the end cap 30 is in a decompressed state, then the compression spring 68 pushes down the lever arm 64 and maintains the lever arm 64 in contact with the trigger switch 62 thereby deactivating the response.

The generated response is a sound which is produced at the speaker 100. The top member 34 has a plurality of openings 35 for enabling the sound produced by the speaker 100 to be more easily heard. Of course, it should be understood that other responses are possible, such as light or a mechanical response.

Figure 4:
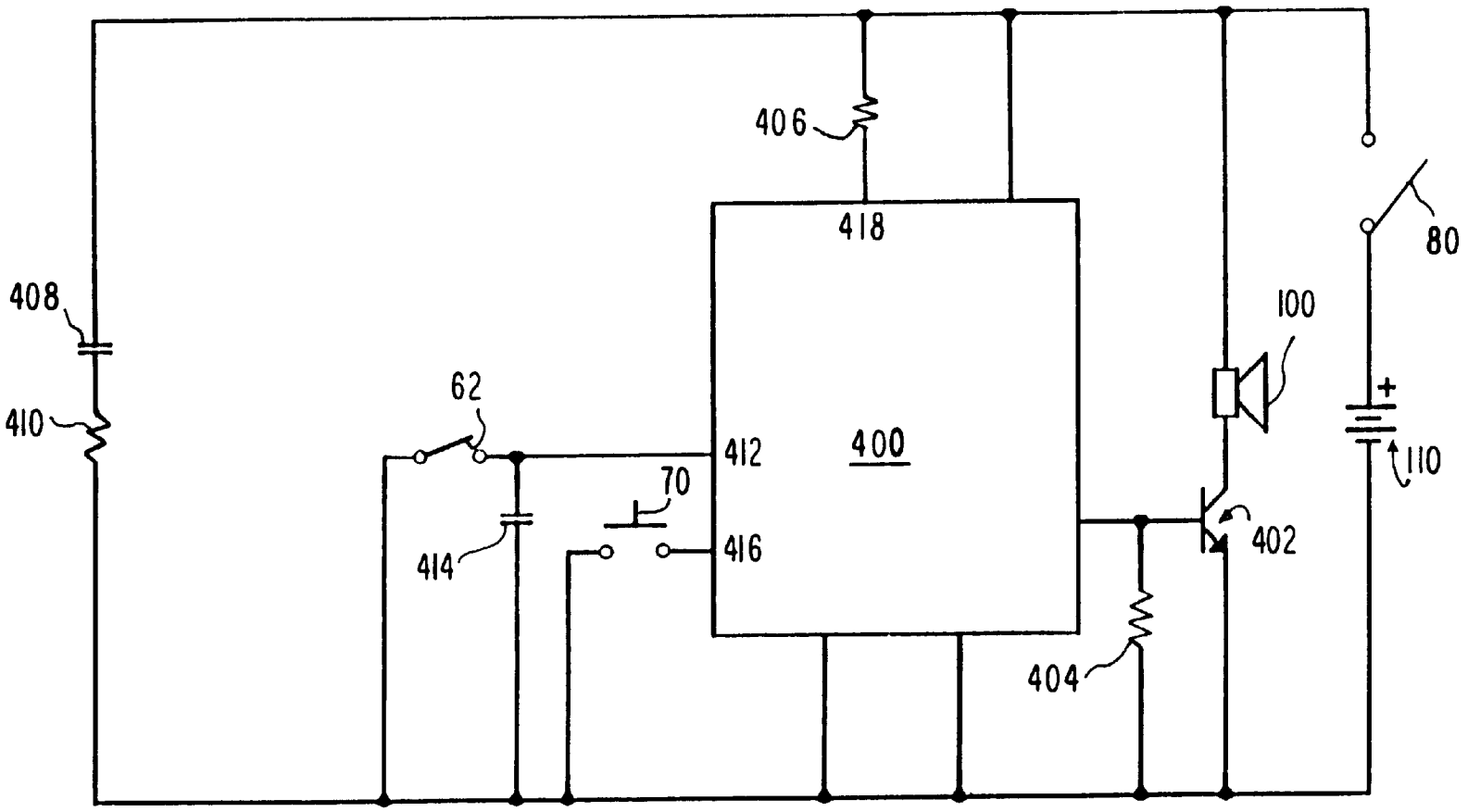
FIG. 4 is an electrical schematic diagram of one embodiment of the present invention.
Figure 5:
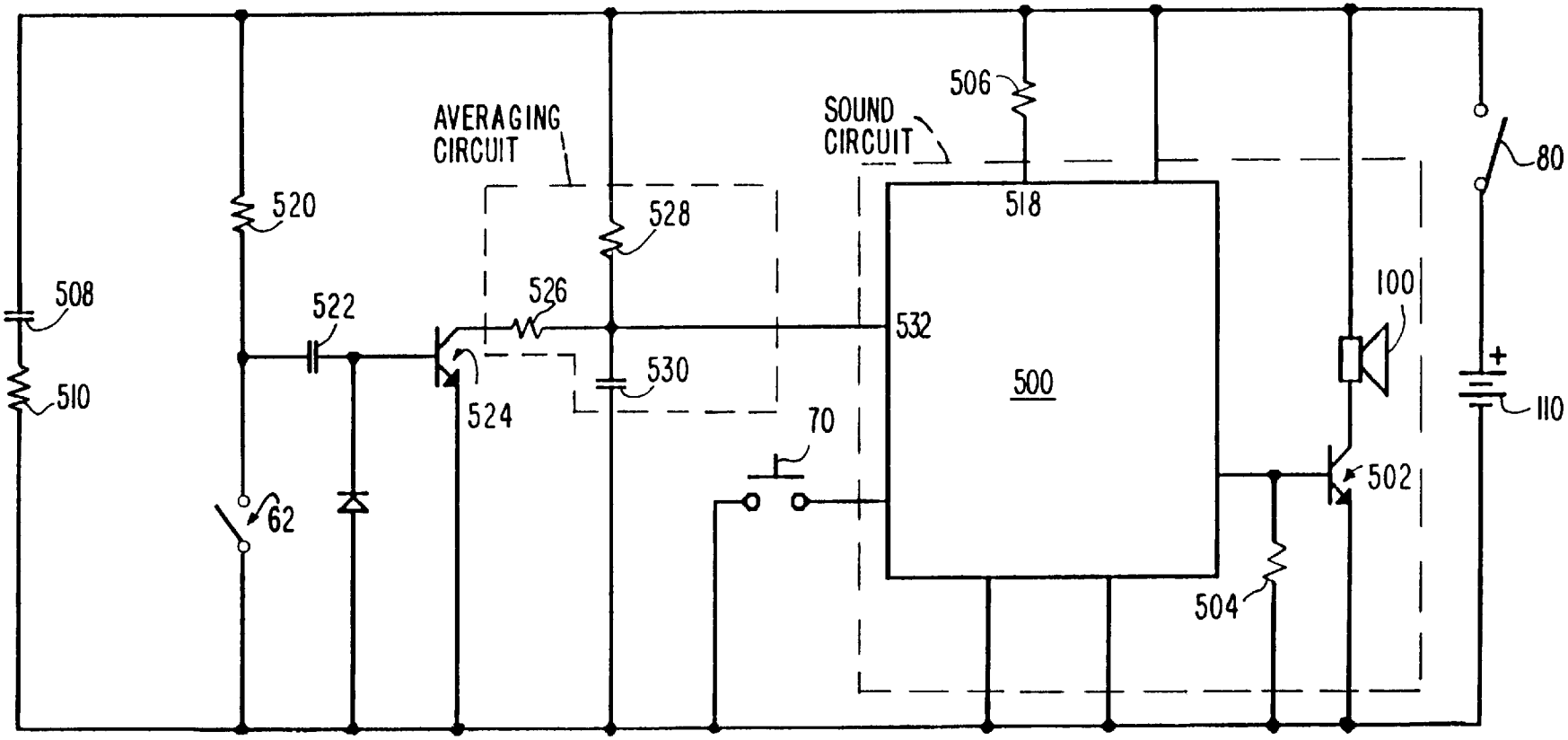
FIG. 5 is an electrical schematic diagram of another embodiment of the present invention.

Referring now to FIGS. 4 and 5, electronic circuitry for different embodiments of the present invention are illustrated. The circuit in FIG. 4 provides a single discrete sound effect for each contact closure of the trigger switch 62. The circuit in FIG. 4 provides a continuous sound effect during a number of repeated contact closures of the trigger switch 62, for as long as the toy is operated.

Referring first to the circuit, as shown in FIG. 4, an integrated circuit 400 is provided for producing sound effects of some sort. Other sound producing circuitry could be used, but an integrated circuit provides maximum flexibility and types of sounds and programming options. A transistor 402, biased by a resistor 404, amplifies the output of the integrated circuit 400 and applies the amplified audio signal to the loudspeaker 100. A resistor 406 supplies current to a clock oscillator 418 as is known in the art. Capacitor 408 provides power supply noise decoupling, with current limited by the resistor 410 for safety reasons, and the battery 110 provides power to the circuit, all of which is also common practice in such circuitry.

The trigger switch 62 is a spring sensing switch. When actuated by the spring toy as described above, the trigger switch 62 closes briefly as the wave of the helical coil and spring 20 reverses direction at the active end cap 30. Closure of the trigger switch 62 produces a falling edge at trigger input 412 of the integrated circuit 400 which causes the integrated circuit 400 generate and to output a sound via the speaker 100. A capacitor 414 can be used as a noise filter should it be found that switch chatter is producing various signal edges at the trigger input 412.

The sound select switch 70 is shown as a push button type switch, and is connected to another trigger input 416, allowing the user to select from among several sound effects, and also allowing the product to be demonstrated in its packaging without actually operating the spring. In one embodiment of the invention the sound select switch 70 enables the selection of eight different pairs of sounds stored in the integrated circuit 400.

Now turning to the circuit shown in FIG. 5, here the trigger switch 62 activates an averaging circuit which in turn controls the sound generating circuit. A pull-up resistor 520 and trigger switch 62 form a voltage divider, whose output is applied to capacitor 522, thereby blocking the status of the trigger switch 62. The sound generator is designed to produce continuous music or sound while the helical coil spring 20 is operating, therefore, means are provided to isolate the static condition of the helical coil spring 20, otherwise sound would be produced continuously in one state of the trigger switch 62 or the other. When the trigger switch 62 is opened, a rising edge is generated at its junction with the resistor 520, which passes through the capacitor 522 thereby energizing the transistor 524. The collector of the transistor 524 is applied to an averaging circuit comprised of resistors 526, 528 and capacitor 530, whose output is connected to the sound generator's input, in this case, 532 of the integrated circuit 500. The sound generator therefore produces continuous sound as long as the input 532 is held at a logic low level. A continuous string of closures and openings of the trigger switch 62 must be produced by operation of the helical coil spring 20 in order to keep the sound going.

Figure 6:
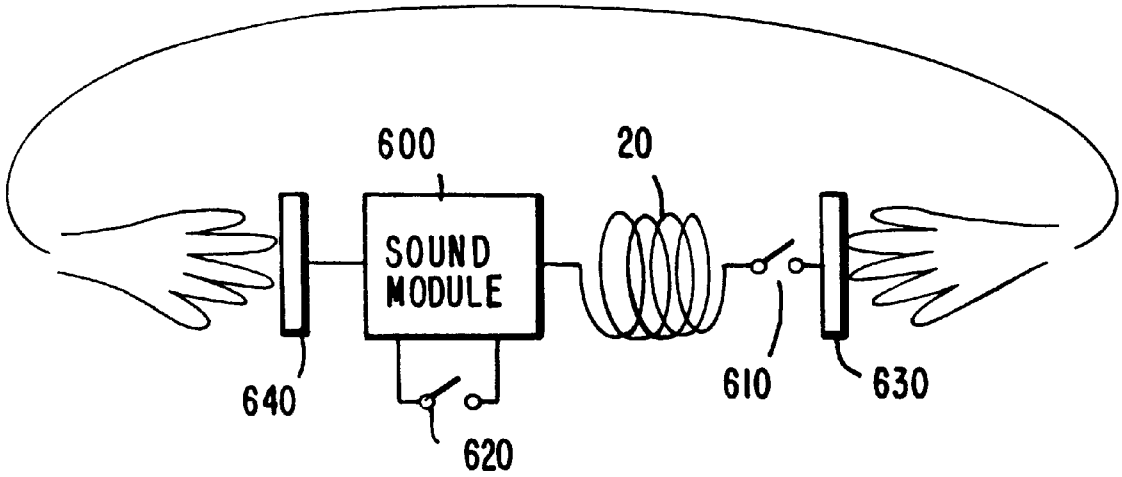
FIG. 6 is a schematic illustration of a further embodiment of the present invention.
Figure 7:
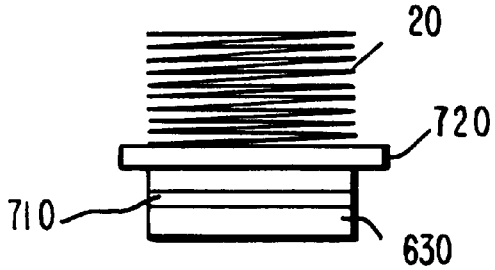
FIG. 7 is a side view of the embodiment of FIG. 6.

FIGS. 6 and 7 show another embodiment of the present invention, in which one end cap 640 has a sound module 600 mounted therein, the sound module 600 being electrically connected to one end of the spring 20. The sound module 600 includes a battery, an integrated chip and a speaker in similar fashion to the embodiments described above. The other end of the spring 20 is electrically connected to a terminal of a remote switch 610, the other terminal of the remote switch 610 being electrically connected to the other end cap 630. Both end caps 630, 640 are made of a conductive material or coated by a conductive material so that a user's body will complete the electrical circuit when the user's hands are placed on the end caps 630, 640. As long as the user's hands maintain contact with the conductive areas on the end caps 630, 640, opening and closing of the remote switch 610 is sensed by the sound module 600 thereby initiating a response. As the user expands and extracts the spring 20, the remote switch 610 continuously opens and closes, thereby completing the circuit through the metal coil spring 20, the switch 610 and back to the sound module 600 through the user's body by the conductive material 710 on the outer surface of the end caps 630, 640. Correct operation of this embodiment of the present invention will be defeated if the user's hands contact the coil spring 20 itself, effectively bypassing the remote switch 610. To prevent this, a small lip 720 is provided around the upper edge of the end caps 630, 640 thereby preventing the user's hands from slipping over the end cap 630, 640 edge and contacting the spring 20. Alternatively, the metal spring could be coated with a non-conductive material.

The invention is not limited by the embodiments described above which are presented as examples only but can be modified in various ways within the scope of protection defined by the appended patent claims.

We claim:

1. A helical coil spring toy, comprising:

a coiled spring having a plurality of connected rings and two free ends, at least two of said plurality of connected rings being moveable relative to each other when said plurality of rings engage in wave-like movement;

an active end cap defining a housing and attachable to one of the free ends of the coiled spring; and means, disposed at said active end cap, for generating an output in response to the wave-like movement of said plurality of rings of the coiled spring.

2. The helical spring toy in accordance with claim 1, wherein the means for generating an output includes an integrated circuit chip generating output signals, the integrated circuit chip having a plurality of inputs and outputs.

3. The helical spring toy in accordance with claim 2, wherein the means for generating an output further includes a trigger switch electrically connected to one of the inputs of the integrated circuit chip, so as to initiate activation of the integrated circuit chip.

4. The helical spring toy in accordance with claim 2, wherein the means for generating an output further includes a sound selector switch electrically connected to one of the inputs of the integrated circuit chip, so as to activate one of a plurality of sounds stored on the integrated circuit chip, and an output device connected to one of the outputs of the integrated circuit chip so as to receive the output signals from said integrated chip and produce a response thereto.

5. The helical spring toy in accordance with claim 2, wherein the means for generating a response further includes an output device electrically connected to one of the outputs of the interred circuit chip, so as to receive the output signals from said integrated circuit chip and to produce a response thereto.

6. The helical spring toy in accordance with claim 5, wherein the output device is a speaker.

7. The helical spring toy in accordance with claim 5, wherein the output device is a light.

8. The helical spring toy in accordance with claim 3, wherein the trigger switch is a push button switch.

9. The helical spring toy in accordance with claim 8, wherein the generating means further includes a lever having a first end contactable with the trigger switch, the lever having a second end arranged so as to be contactable with the second free end of the helical coil spring, and a pivot mounted to the active end cap housing, the lever being rotatably mounted to the pivot at a point between the ends of the lever.

10. The helical spring toy in accordance with claim 2, wherein the integrated circuit chip is programmed to generate a first output signal each time the trigger switch is activated, so as to produce a first response.

11. The helical spring toy in accordance with claim 10, wherein the integrated circuit chip is programmed to generate a second output signal a predetermined amount of time after the first output signal is generated, so as to produce a second response.

12. The helical spring toy in accordance with claim 2, wherein the integrated circuit chip is programmed to generate a continuous output signal when the trigger switch is activated.

13. The helical spring toy in accordance with claim 6, wherein the active and passive end caps are generally cylindrical in shape.

14. The helical spring toy in accordance with claim 9, wherein the lever arm is of an approximate Z-shaped configuration.

15. A helical sprung toy, comprising:

a coiled spring having a plurality of connected rings and a first end and a second end, at least two of said plurality of connected rings being moveable relative to each other when said plurality of connected rings engage in wave-like movement; and an active end cap arranged at said first end of said coiled spring, said active end cap including:

an electronic module including a circuit for outputting signals in response to the wave-like movement of said plurality of rings; and a mechanical switch moveable between a first position at which said electronic module is activated and a second position at which said electronic module is deactivated, said mechanical switch being configured for contact engagement with one of said plurality of connected rings disposed adjacent to said active end cap such that said mechanical switch moves between said first position and said second position in response to the wave-like movement of said plurality of rings of said coiled spring.

16. The helical spring toy of claim 15, wherein said mechanical switch includes a lever pivotally mounted to said active end cap, said lever having an end dimensioned and shaped for contact engagement with said one of said plurality of rings adjacent said active end cap so that said lever pivots between said first and second positions of said mechanical switch in response to wave-like movement of said plurality of rings, thereby causing said mechanical switch to move between said first position and said second position.

17. The helical spring toy of claim 15, wherein said electronic module includes an integrated circuit chip.

18. The helical spring toy of claim 17, wherein said output signals represent sound.

19. The helical spring toy of claim 18, further comprising a speaker for converting said output signals into sound.

* * * * *